United States Patent [19]

McKnight

[11] Patent Number: 4,844,447

[45] Date of Patent: Jul. 4, 1989

[54] SOUND AND VISUAL DISPLAY APPARATUS

[76] Inventor: David C. McKnight, 429 E. 64th St., Apt. 5K, New York, N.Y. 10021

[21] Appl. No.: 261,350

[22] Filed: Oct. 24, 1988

[51] Int. Cl.[4] ..... A63H 33/00

[52] U.S. Cl. ..... 272/27 N; 272/7; 272/8 N; 446/168; 446/171; 273/121 B; 273/121 E

[58] Field of Search ..... 272/1 R, 8 N, 8 R, 27 N, 272/27 R, 7; 273/1 L, 121 E, 121 B; 446/166–172

[56] References Cited

U.S. PATENT DOCUMENTS

| | | | |
|---|---|---|---|
| 1,615,342 | 1/1927 | Nelson | 446/172 |
| 2,522,133 | 9/1950 | Sanders | 446/171 |
| 3,782,729 | 1/1974 | Ernst | 446/171 X |
| 4,128,964 | 12/1978 | Ogasawara | 446/171 |

*Primary Examiner*—David A. Scherbel
*Assistant Examiner*—Richard E. Chilcot, Jr.
*Attorney, Agent, or Firm*—Collard, Roe & Galgano

[57] ABSTRACT

An apparatus for producing a sound and visual display has a generally upstanding tubular body having a circumferential wall defining a centrally located vertically extending longitudinal axis. A reservoir is formed in the lower part of the generally cylindrical tubular body with a plurality of bead-like objects normally stored in the reservoir. An auger is used to transport the bead-like objects from the reservoir to an upper portion of the generally cylindrical tubular body. The body also includes a plurality of generally horizontally extending spokes supported on the circumferential wall and extending inwardly at vertical intervals with respect to the vertically extending longitudinal axis. A plate forms the bottom of the upper portion of the body and extends in a direction generally perpendicular to the vertically extending longitudinal axis and includes at least one releasable door therein. A timer controls the opening of the releasable door at predetermined intervals based upon the sufficient accumulation of bead-like objects in the upper portion allowing the beads to fall through the plurality of spokes. Lights are provided to light the display and the bead-like objects as they fall downwardly.

11 Claims, 1 Drawing Sheet

SOUND AND VISUAL DISPLAY APPARATUS

BACKGROUND OF THE INVENTION

1. Field of the Invention

This invention relates to an apparatus for producing a sound and visual display. More paticularly it relates to an apparatus in which bead-like objects fall, at intervals, through a tube having spokes extending into the interior thereof which spokes produce a wavelike sound when impacted by the beads falling downwardly through the tube.

2. Description of the Prior Art

Throughout history there have been many novelty devices which stimulate interest and entertainment by the unique production of sound and movement. In Africa a device which utilizes pebbles and sticks was used to produce musical sounds by dropping the pebbles through a container having the sticks running generally horizontally therethrough. People have also used wind chimes to produce both visual and sound effects which chimes are still utilized today. After the invention of electricity, devices producing visual and sound entertainment became more common with the use of products such as liquid timers and lava lamps. These devices produce visual displays and other devices use recordings of natural such as rain waves and storms for sound entertainment.

While devices have been marketed which produce natural sounds and wave-like light displays, the present invention is an apparatus which results in the production of unusual light movement and color production while at the same time producing sounds like waves lapping the seashore. Also, like the surf at night with its phosphorous and green reflections, the present invention displays a shower of green sparks when operated in the dark.

SUMMARY OF THE INVENTION

It is an object of this invention to provide a sound and light display apparatus which simulates the movement and sound of waves.

It is yet another object of the invention to provide a compact, electrically lit and powered, acrylic plastic apparatus in which objects are conveyed from the bottom thereof to the top thereof and allowed to fall across spokes extending into the interior thereof, thus producing a pleasing sound.

It is yet another object of the invention to provide a light and sound display apparatus which is simple in design, pleasing in appearance, simple to operate, and capable of producing an entertaining sound and light display.

Accordingly, these and other objects are achieved by an apparatus for producing a sound and visual display composed of a generally cylindrical tubular body having a circumferential wall of predetermined thickness defining a centrally located vertically extending longitudinal axis. The tubular body includes a spiral auger rotatable about the vertically extending longitudinal axis for transporting a multiplicity of bead-like objects from a reservoir in the lower portion of the generally cylindrical tubular body to an upper portion thereof. The multiplicity of bead-like objects are stored in the reservoir after falling through the apparatus and then are lifted by the auger to the upper portion. The generally cylindrical tubular body includes a plurality of generally horizontally inwardly extending spokes fixed on the circumferential wall at vertical intervals with respect to the vertically extending longitudinal axis. Each spoke is attached at its first end to the wall and extends inwardly of the cylinder a distance less than the radius of the cylinder with its second end normally unsupported. Thus as the bead-like objects fall through the generally cylindrical tubular body they strike the inwardly extending spokes thereby producing a pleasing sound.

Preferably, a plate forms a bottom of the upper portion of the generally cylindrical tubular body and extends in a direction perpendicular to the vertically extending longitudinal axis. Advantageously, the plate has at least one releasable door therein, the release of which door may be controlled by a timer which, based on the number of revolutions of the spiral auger, opens the door after a predetermined number of bead-like objects have been conveyed from the reservoir to the upper portion. Thus, a wave-like production of sound occurs at regular intervals each time the door opens and the bead-like objects strike the spokes as they fall into the reservoir. In order to produce a variety of sounds, the beads are made of different materials such as acrylic, steel, glass and/or any other suitable material.

In order to facilitate the movement of the bead-like objects from the reservoir to the upper portion, a small diameter interior tube may be placed around the auger so that the beads are prevented from moving radially outwardly thereof as they move upwardly in the cylinder. It is contemplated that the auger would be rotated by a small electric motor mounted in the upper portion of the apparatus.

The apparatus preferably contains at least two lights designed to shine through the wall of the generally cylindrical tubular body which is usually made of acrylic plastic. Normally the spokes are also acrylic plastic and are attached to the wall of the hollow cylindrical body by drilling holes therethrough and placing the ends of the spokes in the holes. When properly lit the light permeates through the tube lighting each individual hole which is cut in the wall and therefore each acrylic spoke. These holes may be filled with spokes of different diameters and colors and can be arranged in a predetermined pattern. Thus a pattern will light up within the interior of the device by a process similar in concept to a childen's toy sold under the trademark LITE-BRITE.

In addition, a light may be placed in the center of the device to make the interior more visible, especially at night, and to light the bead-like objects as they fall through the device. It is contemplated that this light will charge a portion of the beads which will contain a "glow in the dark" material. Thus, when the apparatus is placed in a dark room and allowed to operate phosphorescent bead-like objects will appear as a brilliant shower of sparks.

These and other objects and features of the present invention will become apparent from the following detailed description considered in connection with the accompanying drawing, which discloses one embodiment of the invention. It is to be understood that the drawing is to be used for the purposes of illustration only, and not as a definition of the limits of the invention.

BRIEF DESCRIPTION OF THE DRAWING

In the drawing, wherein similar reference characters denote similar elements throughout the several views.

DESCRIPTION OF THE PREFERRED EMBODIMENT

Figure 1:
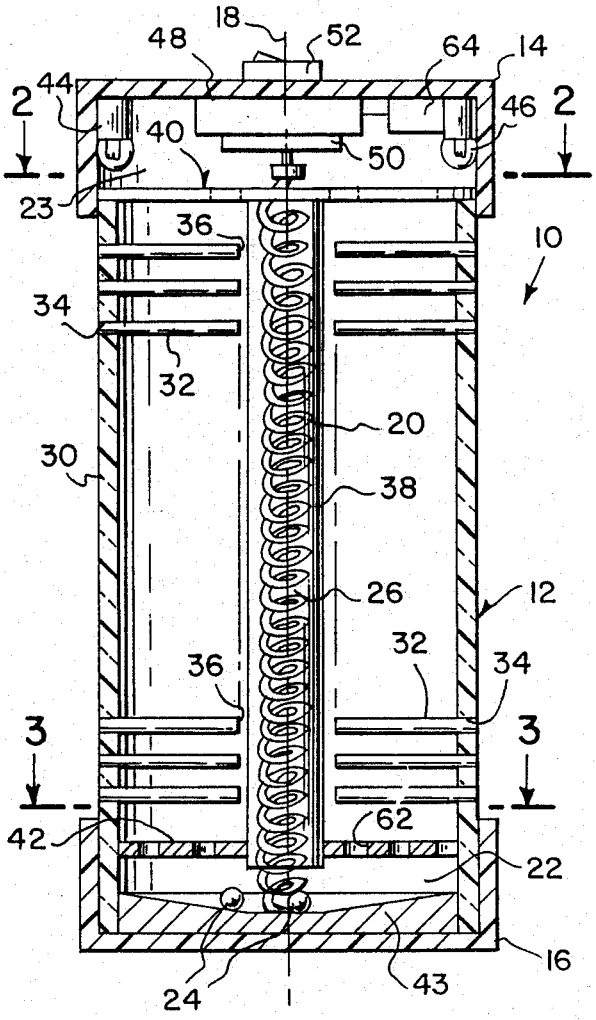
FIG. 1 is a vertical cross-sectional view of the sound and light display apparatus on the present invention.

Referring to FIG. 1 there is shown a sound and light display apparatus generally denoted as 10. Apparatus 10 has a tubular body in the form of a generally cylindrical tubular body 12 forming the outer perimeter thereof. Tubular body 12 is closed at its upper end by top cap 14 and at its lower end by bottom cap 16. A vertically extending longitudinal axis 18 extends vertically through the center of apparatus 10 and forms the axis of rotation of an auger 20. Auger 20 extends from a reservoir 22 formed in the area of bottom cap 16 to an upper portion 23 of tubular body 12 in the area of top cap 14. Reservoir 22 holds a plurality of bead-like objects 24 which are 1 sized to match the pitch or spacings 26 of auger 20.

Tubular body 12 is composed of a circumferential wall 30 having a plurality of inwardly extending spokes 32 fixed thereto. It is anticipated that each of spokes 32 would be inserted into a hole 34 of appropriate size formed in wall 30 of tubular body 12. Spokes 32 may be of varying diameters and thus holes 34 would correspond to the diameters of spokes 32 to be inserted therein. In order to produce a more pleasing sound, spokes 32 are not supported at their inner ends 36 so they may vibrate when struck by bead-like objects 24 during operation as will be described below.

The purpose of auger 20 is to transport bead-like objects 24 from reservoir 22 to upper portion 23 of light and sound display apparatus 10. In order to prevent bead-like objects 24 from moving in the radial direction out of engagement with auger 20, a tubular member 38 surrounds auger 20 in close proximity therewith. Because the inner diameter of tubular member 38 is only slightly greater than the outer diameter of auger 20, it prevents bead-like objects 24 from disengaging from auger 20 and prematurely falling through tubular body 12.

An upper plate 40, forming the base of upper portion 23 extends across tubular body 12 in a direction generally perpendicular to longitudinal axis 18. Plate 40 supports the upper end of both auger 20 and tubular member 38. Likewise a perforated plate 42 extends across the top of reservoir 22 and supports the lower end of tubular member 38. Plate 42 has perforations sized to allow bead-like objects 24 to fall therethrough into reservoir 22. The lower end of auger 20 is supported in a receptacle 43 located in reservoir 22.

Mounted to top cap 14 are at least two lights 44 and 46 and motor 48. In addition, a light 50 may be mounted on motor 48 and located in close proximity to axis 18 whereas lights 44 and 46 are adjacent the periphery of top cap 14 and circumferential wall 30 of tubular body 12. A switch 52 is provided to connect apparatus 10 with a power source to power lights 44, 46 and 50 and motor 48. Motor 48 is coupled to the upper end of auger 20 and causes the rotation thereof which moves bead-like objects 24 from reservoir 22 to upper portion 23.

Figure 2:
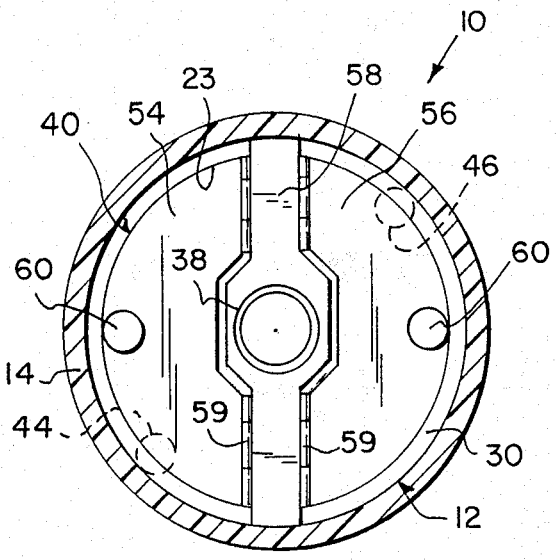
FIG. 2 is a cross-sectional view of the light and sound display apparatus shown in FIG. 1 along the line 2—2 thereof.
Figure 5:
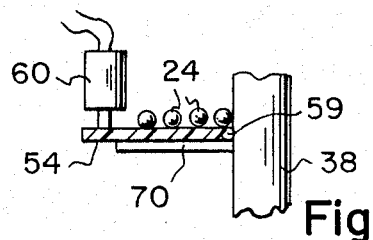
FIG. 5 is a partial cross-sectional view of a bead release system of the present invention.

Referring to FIG. 2 there is shown upper plate 40 which includes a pair of releasable doors 54 and 56. Doors 54, 56 are hinged at the inner side thereof to a support 58 which forms the center of plate 40 via hinges 59. Support 58 supports the upper end of tubular member 38 and is fixedly attached to circumferential wall 30. Doors 54 and 56 are selectively releasable upon the accumulation of a predetermined number of bead-like objects 24 in upper portion 23 and, upon release, allow these objects to fall through the cylindrical tubular body 12 contacting spokes 32 as they fall.

Figure 3:
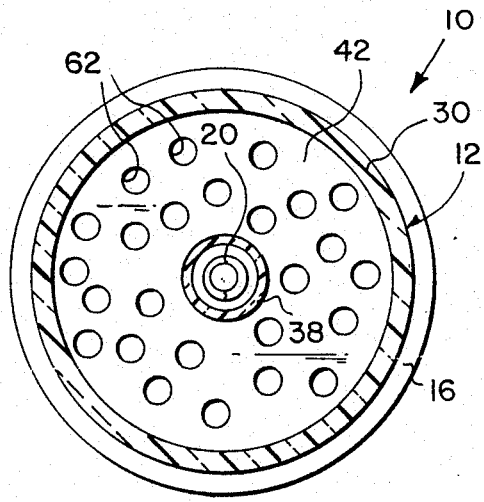
FIG. 3 is a cross-sectional view of the sound and light display apparatus as shown in FIG. 1 along the line 3—3 thereof.
Figure 4:
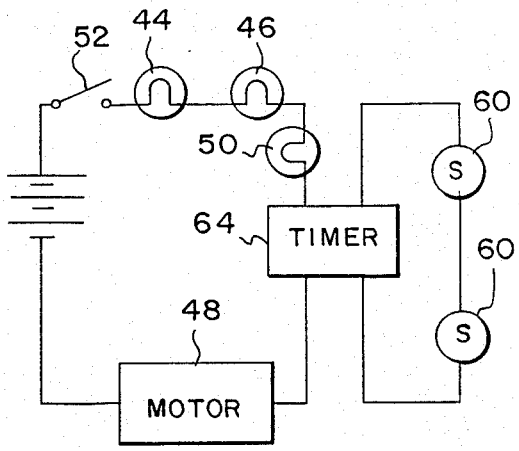
FIG. 4 is a control circuit for controlling the movement of bead-like objects within the apparatus of FIG. 1.

Referring to FIG. 3 there is shown perforated plate 42 with perforations 62 which plate 42 is fixed to circumferential wall 30 and provides the support of the lower end of tubular member 38. Referring to FIG. 4 there is shown a control circuit for the apparatus 10 in which a timer 64 is utilized to control solenoids 60 which control the release of doors 54 and 56. When switch 52 is closed the lights 44, 46 and 50 are turned on and timer 64 starts simultaneously with motor 48. Knowing the speed of rotation of motor 48 and thus auger 20 the number of bead-like objects 24 moving from reservoir 22 to upper portion 23 can be determined, and, after a predetermined time timer 64 causes the release of doors 54 and 56 allowing the bead-like objects to fall through the apparatus to produce a sound and light display.

While timer 64 and solenoids 60 are shown it is also possible to control the release of bead-like objects 24 by solely a spring 70 placed under each door 54, 56. Spring 70 may also be in the form of a hinge spring which is coiled around hinges 59. Upon a sufficient load (accumulation of bead-like objects) doors 54, 56 spring open and allow the bead-like objects to fall. The release of bead-like objects 24 may be controlled by the deenergization of solenoid 60 at predetermined intervals. After the bead-like objects drop springs 70 return doors 54, 56 to the closed position where they are held closed by energized solenoid 60 until again de-energized by timer 64. In addition, spring 70 can be designed to open automatically under the weight of a sufficient number of bead-like objects 24.

This sound and light display occurs because bead-like objects 24 are made of, e.g., acrylic, steel and/or glass and, upon hitting spokes 32 cause a distinctive sound to be produced. Spokes 32 may be of varying diameters and preferably are made of acrylic plastic rods of varying colors. Upon the release of doors 54 and 56, bead-like objects 24 not only fall through the interior of tubular body 12, but lights 44, 46 and 50 shine therethrough to give the falling objects a pleasing visual appearance. Preferably, the cylindrical tubular body 12 is made of acrylic plastic, as are spokes 32. Thus even if doors 54 and 56 are opaque and are closed, lights 44, 46 produce a light effect in wall 30 which effect is carried toward the interior of the apparatus 10 by the plurality of spokes 32 in a manner similar to the well known childrens toy sold under the trademark LITE-BRITE.

After bead-like objects 24 have fallen through apparatus 10, spring member 70 closes doors 54 and 56, thereby allowing the cycle to restart with auger 20 transporting bead-like objects vertically upwardly through tubular member 38 into upper portion 23 of apparatus 10. Again, after a predetermined time or after a predetermined accumulation of bead-like objects 24 occurs, doors 54 and 56 again open allowing for another "wave-like" sound and light display to occur. It is contemplated that the cycle time would be approximately every 2 to 3 minutes.

While tubular body 12 is preferably cylindrical, any multi-sided hollow body shape may be used. In addition, instead of plastic, tubular body 12 may be made of any transparent material such as glass. Bead-like objects 24 may be made of a light absorbing or phosphorescent material so to "glow in the dark".

While several embodiments of the present invention have been illustrated and described, it is obvious that many changes and modifications may be made thereunto, without departing from the spirit and scope of the invention.

What is claimed is:

1. An apparatus for producing a sound and visual display comprising:

a generally upstanding tubular body having a circumferential wall defining a vertical longitudinal axis extending therethrough and having an upper portion and a lower portion;

a reservoir formed in said lower portion of said tubular body;

a multiplicity of bead-like objects normally stored in said reservoir;

means for transporting said bead-like objects from said reservoir to said upper portion of said tubular body;

a plurality of spokes supported by and extending within said tubular body between said upper and lower portion thereof in a direction generally perpendicular to said vertically extending longitudinal axis; and means for accumulating said bead-like objects received in said upper portion of said tubular body from said means for transporting said bead-like objects, and releasing said accumulated bead-like objects to fall from said upper portion to said lower portion of said tubular body.

2. An apparatus for producing a sound and visual display as set forth in claim 1 wherein said means for accumulating and releasing said beads comprises:

a plate forming a bottom of said upper portion of said tubular body and extending in a direction generally perpendicular to said vertically extending longitudinal axis;

at least one releasable door formed in said plate forming said bottom of said upper portion; and means for controlling said releasable door causing the opening thereof at predetermined intervals based upon a sufficient accumulation of said bead-like objects in said upper portion of said tubular body to allow said bead-like objects to fall through said tubular body, striking said plurality of spokes as they fall towards said reservoir.

3. The apparatus for producing a sound and visual display as set forth in claim 2, wherein said means for controlling the release of said releasable door at predetermined intervals includes a selectively releasable locking means operatively coupled between said door and a portion of said plate forming a bottom of said upper portion fixed to said circumferential wall, the release of said locking means being controlled by a timer.

4. The apparatus for producing a sound and visual display as set forth in claim 2 wherein said means for controlling said releasable door causing it to open at predetermined intervals includes a spring means for sensing the weight of accumulated bead-like objects in said upper portion of said tubular body and releasing the same upon a predetermined accumulation.

5. The apparatus for producing a sound and visual display as set forth in claim 1, further including a light for producing illumination in the interior of said tubular body.

6. The apparatus for producing a sound and visual display as set forth in claim 1, wherein said means for transporting said bead-like objects from the reservoir to said upper portion of the tubular body includes a vertically extending spiral auger.

7. The apparatus for producing a sound and visual display as set forth in claim 6, wherein said spiral auger is rotated by an electric motor mounted in said upper portion of said tubular body.

8. The apparatus for producing a sound and visual display as set forth in claim 6, wherein said spiral auger is surrounded by a vertically extending tubular member for preventing movement of said bead-like objects out of engagement with said spiral auger.

9. The apparatus for producing a sound and visual display as set forth in claim 1, wherein said tubular body and said plurality of spokes are make of acrylic plastic.

10. The apparatus for producing a sound and visual display as set forth in claim 1, wherein the plurality of spokes have a first end fixed to said wall and have a free inner end extending inwardly toward said vertical longitudinally extending axis a distance less than the radius of the tubular body.

11. The apparatus for producing a sound and visual display as set forth in claim 1, wherein the bead-like objects are made of a phosphorescent material.

* * * * *